United States Patent [19]

Peterson

[11] 4,050,189

[45] Sept. 27, 1977

[54] DEVICE FOR OPERATING A POCKET DOOR

[75] Inventor: Francis C. Peterson, St. Louis County, Mo.

[73] Assignee: C. Hager & Sons Hinge Manufacturing Company, St. Louis, Mo.

[21] Appl. No.: 610,133

[22] Filed: Sept. 4, 1975

Related U.S. Application Data

[63] Continuation-in-part of Ser. No. 473,003, May 24, 1974, abandoned.

[51] Int. Cl.[2] ..... E05F 15/14

[52] U.S. Cl. ..... 49/26; 49/139; 49/360; 318/285

[58] Field of Search ..... 49/26–30, 49/360, 139; 318/283–285, 290

[56] References Cited

U.S. PATENT DOCUMENTS

| | | | |
|---|---|---|---|
| 3,223,402 | 12/1965 | Glenn | 49/28 |
| 3,247,615 | 4/1966 | Kalog | 49/30 |
| 3,429,073 | 2/1969 | Tucker, Jr. | 49/30 X |

*Primary Examiner*—Kenneth Downey

*Attorney, Agent, or Firm*—Gravely, Lieder & Woodruff

[57] ABSTRACT

A pocket door is moved between open and closed positions by an electric motor unit mounted on the studs framing the rough opening in which the door is installed. The rotary motion of the motor is translated into linear motion by a cable and pulley arrangement with one of the pulleys being a drive pulley on the shaft of the motor unit and the other being an idler pulley mounted on the track on which the door slides. The cable is attached to the door through a coil-type tension spring. Hence, the door will move when the motor is energized and should the door encounter an impediment upon closing the spring will expand and permit the pulley to slip within the loop of the cable. The motor is controlled by a timer which when activated causes the motor to run for sufficient time to open the door, then hold to enable one to pass through the door opening, and then run in the opposite direction for sufficient time to close the door.

14 Claims, 4 Drawing Figures

DEVICE FOR OPERATING A POCKET DOOR

CROSS-REFERENCE TO RELATED APPLICATION

This application is a continuation-in-part of copending application, Ser. No. 473,003, filed May 24, 1974 abandoned.

BACKGROUND OF THE INVENTION

This invention relates in general to doors, and more particularly to an automatically operated sliding door such as a pocket door.

A pocket door, in contrast to a conventional hinged door, slides between open and closed positions. When in its open position, the typical pocket door occupies a pocket within the wall, and all but the edge of the door is completely concealed. Since a pocket door does not swing into either of the areas it separates, it is ideally suited for use where space is limited adjacent to the door. Notwithstanding the relatively little space required, pocket doors are not conveniently opened and closed, and for that reason they are used only where space is at a premium. In order to open the typically manually operated pocket door of the type found in residential construction, one must grasp a retractable handle in the edge of the door and pull the door out of its pocket, making sure to withdraw his hand before the door is completely closed.

Heretofore, attempts have been made to automate the operation of pocket doors, but these attempts have involved complicated electrical circuits including limit switches to sense when the door is completely open or closed. Also, unless provided with adequate safeguards, these automated doors can be quite dangerous to individuals caught in them as they close. The safeguards to prevent a closing door from injuring someone usually involve some type of sensing device for detecting when the door encounters excessive resistance and sensing devices of this nature complicate the electrical circuitry even further.

SUMMARY OF THE INVENTION

One of the principal objects of the present invention is to provide means for actuating a pocket door merely by operating a switch located near the door or at some remote location. Another object is to provide means of the type stated which utilizes extremely simple electrical circuitry and does not require limit switches, obstacle sensing devices, and the like. A further object is to provide means of the type stated which can be used with pocket door units of current manufacture. These and other objects and advantages will become apparent hereinafter.

The present invention is embodied in a drive unit which is coupled to a sliding type door for opening and closing the same. The drive means is connected to the door by connecting means which translates rotary motion into linear motion. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
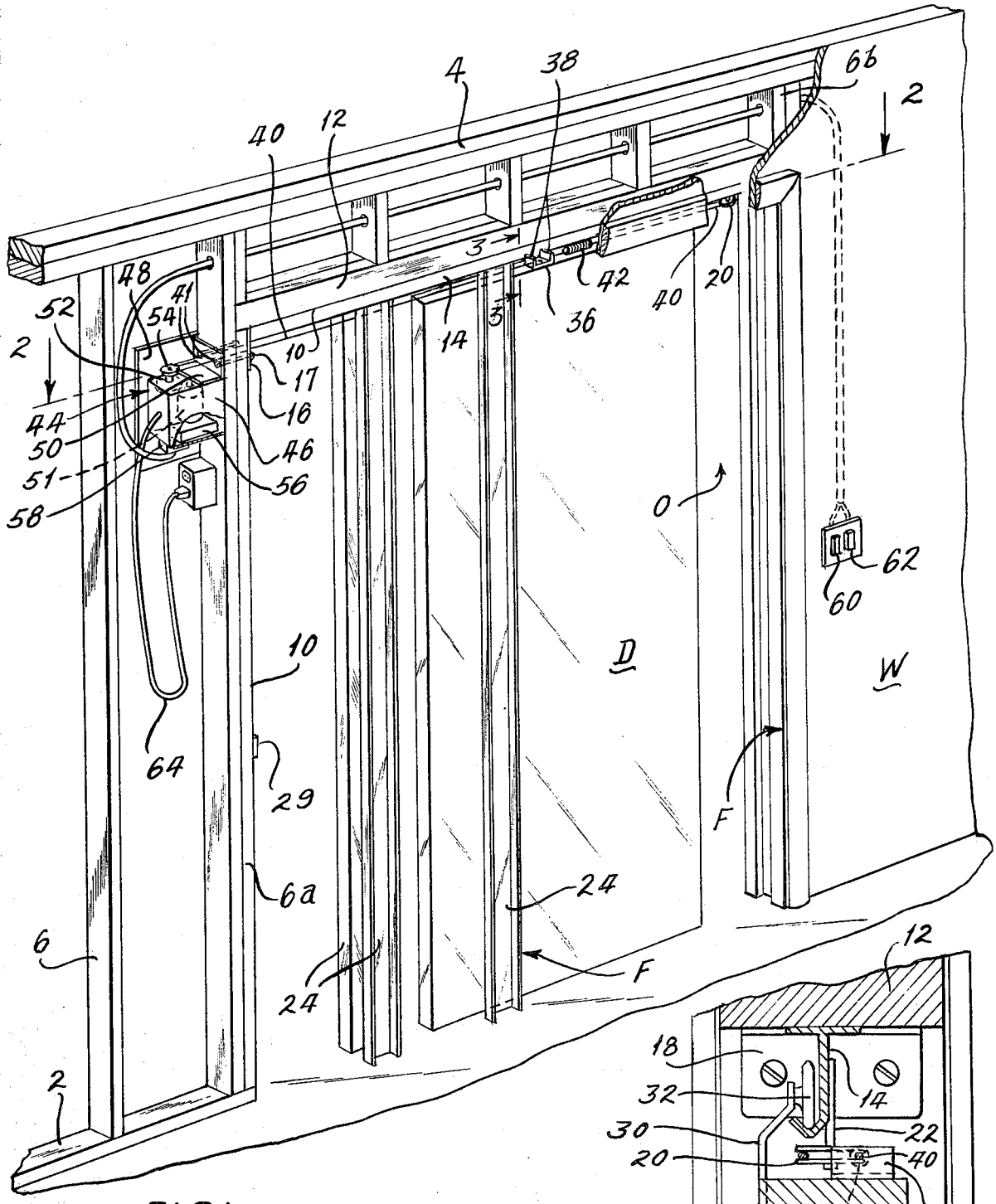
FIG. 1 is a perspective view, partially broken away, of a pocket door provided with the drive unit of the present invention for opening and closing the same.

Referring now to the drawings, a wall W (FIG. 1) has a door frame F partially concealed within it, and the door frame F carries a pocket door D which slides relative to the frame F between open and closed positions. When in the open position, the door D is housed completely within the frame F, and except for its one side edge it is completely concealed by the wall W, leaving an opening O opposite that exposed side edge to permit passage through the wall W. When in its closed position, the door D occupies the opening O, blocking the same. The door frame F with the pocket door D in it are usually supplied as a unit and is available from most suppliers of building materials.

The wall W is conventional in construction and includes the usual sill and top plates 2 and 4 between which studs 6 extend. Nailed to the studs 6 is so-called dry wall or wallboard 8. The wall W has a rough opening 10 (FIG. 1) in it and this opening is framed along its sides by double studs **6*a* and 6*b* and along its top by a header 12. The rough opening 10** is slightly larger than the door frame F.

Figure 3:
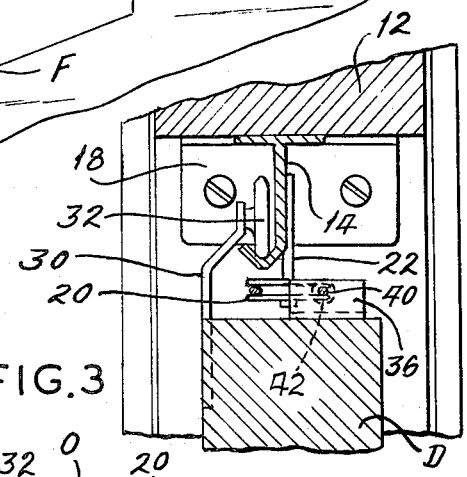
FIG. 3 is a sectional view taken along line 3—3 of FIG. 1.

The door frame F fits into the rough opening 10 and contains the door opening O which is about one half the size of the rough opening 10. The frame F includes a horizontal track member 14 (FIG. 3) which is located against the underside of the header 12 and extends substantially the full width of the rough opening 10. One end of the track member 14 is attached to a bracket 16 which in turn is secured to the double studs **6*a* by bolts 17 extended completely through the studs 6*a*. The other end of the track member 14 has a bracket 18 which is attached to the double studs 6*b*. Near the bracket 18, the track member 14 has a pulley 20 which rotates about a vertical pin 22 fixed in the track member 14**.

In addition to the track member 14, the door frame F has vertical members 24 which are arranged in pairs with one pair being at the center of the frame and along one side of the opening O and the other pair being offset toward the double studs **6*a*. The upper ends of the vertical member 24 are attached to the track member 14. The lower ends are attached to the floor. The pairs of vertical members 24 create a pocket 28** which opens toward the opening O along one side of the opening O.

The door D fits into the pocket 28 when open and abuts an elastomeric bumper 29 (FIG. 1) on the double studs **6*a*. When closed, the door D occupies the opening O. Its width is slightly less than the space between the centermost frame studs 24 and the double studs 6*b* of the wall W so that it can be fitted into the opening O and then moved into the pocket 28. The door D has a pair of roller brackets 30 (FIG. 3) at its upper end and these brackets are provided with rollers 32 which roll along the track of the track member 14. The brackets 30 in effect suspend the door D from the track member 14** and permit it to move easily between its open and closed positions.

Fastened to the top edge of the door D between the two roller brackets 30 thereon is a cable bracket 36 having upwardly directed tabs 38 at each end. One tab 38 is presented toward the idler pulley 20 and the double studs 6b, and even when the door D is completely closed, that tab 36 is located beyond the pulley 20, that is it is between the pulley 20 and the double studs 6a. The other tab 36 is presented toward the double studs 6a and even when the door D is completely open it is spaced from the studs 6a.

Figure 2:
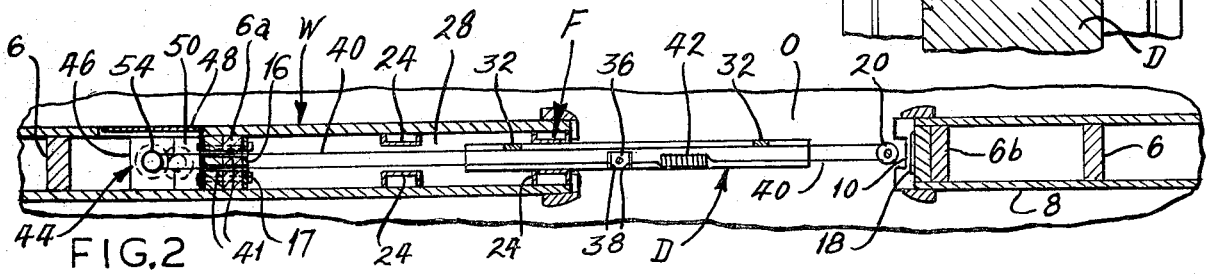
FIG. 2 is a sectional view taken along line 2—2 of FIG. 1.

Attached to the door D through the bracket 36 is a cable 40 (FIG. 2), a portion of which loops around the idler pulley 20, while another portion extends through the double studs 6a, forming a loop beyond them. In particular, one end of the cable 40 is attached to the bracket 36 at the tab 38 thereon located closest to double studs 6a. From that tab, the cable 40 extends along the track member 14 all the way to the double studs 6a, and passes through a hole 41 located in the track bracket 16 and studs 6a. The cable forms a loop beyond double studs 6a and then passes through another hole 41 in the double studs 6a and track bracket 16. This portion of the cable 40 extends uninterrupted to the idler pulley 20, around which it is trained. Beyond the idler pulley 20, the opposite end of the cable 40 is attached to a coil-type tension spring 42 which in turn is attached to the bracket 36 at the tab 38 thereon located closest to the double studs 6b. Thus, any lineal movement of the cable 40 will impart a corresponding movement to the door D.

The cable 40 is moved in both directions by a drive unit 44 (FIGS. 1 and 2) which is secured to the double studs 6a on the opposite side thereof from the bracket 16 for the track member 14. The drive unit is electrically powered and for the most part is contained within a metal housing 46 of box-like configuration. This housing 46 is no wider than the studs 6 so that it fits entirely between the wallboard 8 nailed to the studs 6. Hence, no furring is necessary. Fitted into the wallboard 8 on one side of the wall W at the drive unit 44 is a standard access door 48 which is large enough to accommodate the drive unit 44 so that the drive unit can be adjusted or even removed for servicing.

The drive unit 44 is secured to the double studs 6a by a right angle bracket 50 which has one of its legs welded to the metal housing 46. The other leg of the bracket 50 is flush with one side of the housing 46 and lies along the double studs 6a. The bolts 17 extends through the bracket 50 and thereby secure both the drive unit 44 and the track member 14 to the double studs 6a. The upwardly projecting leg of the bracket 50 also has holes 41 (FIGS. 1 and 2) through which the cable 40 extends and the axes of these holes 41 lie in the horizontal plane of the axes for the two bolts 17. Hence, the drive unit 44 may be mounted on the double studs 6a with its housing 46 either above or below the right angle bracket 50 and the looped portion of the cable 40.

The housing 44 contains a motor unit in the form of a so-called gear motor 51 (FIG. 1), that is an electric motor provided with a small gear box to achieve a speed reduction. The gear motor 51 is reversible and has a drive shaft 52 which projects vertically through that end wall of the housing 46 at which the right angle bracket 50 is located. The drive shaft 52 carries a drive pulley 54 which is preferably made of steel and aligns with the holes 41 through which the cable 40 extends. The looped portion of the cable 40 fits around the drive pulley 54 so that when the pulley 54 rotates, the cable 40 will move. Since the door D is attached to the cable 40 through the bracket 36, the door D will likewise move. In this connection, the length of the cable 40 is such that the spring 42 is always maintained under a moderate amount of tension so that the cable 40 is always taut. The tension exerted by the spring 42 should be between 10 and 25 lbs. depending on the weight of the door. Thus, when the motor 51 is energized in one direction, it will move the door D to its open position with the opening force being exerted entirely through the cable 40. When the motor 51 is energized in the opposite direction the door D is moved to its closed position with the force being exerted through both the cable 49 and the spring 42.

Aside from the foregoing mechanical components, the drive unit 44 also includes a timer unit 56 (FIG. 1) which controls the motor and is located in the housing 46 at the end thereof opposite the end from which the drive shaft 52 projects. The end wall at that end of the housing 46 carries a junction block 58 which has exposed terminals to which the two leads of a start button 60 are attached and more terminals to which the two leads of a hold button 62 are attached. Normally, a set of start and hold buttons 60 and 62 is installed on one side of the wall W adjacent the door opening O and another set on the other side of the wall W. The leads of the buttons 60 and 62 are merely connected to the junction block 58 in parallel. More buttons 60 and 62 may be installed at remote locations and connected to the junction block 58 in a like manner. The timer unit 56 as well as the motor 51 derive electrical energy through a power cord 64 which extends from the housing 46 and plugs into a conventional duplex receptacle 66 mounted on the double studs 6a.

Preferably, the timer unit 56 is a solid state device which is energized by momentarily depressing one of the start buttons 60. The electronic circuitry of the timer unit 56 is such that once energized, it causes the motor 51 to rotate the drive shaft 52 for a prescribed amount of time in the direction which opens the door D, then de-energizes the motor 51 for a prescribed amount of time, and then energizes the motor 51 in the opposite direction for a prescribed amount of time to close the door D. The time in which the motor 51 operates in each direction should be long enough to completely open or close the door D, whatever the case may be. These times may be variable to accommodate doors D of different width, and the adjustment is made by merely turning set screws which are accessible when the access door 48 is open. The time at which the motor remains de-energized between movement in both directions should be long enough to enable one to pass through the door opening O. The hold button 62 merely stops the timer unit 56 wherever in the sequence it may be. Thereafter, when one of the start buttons 60 is again pressed, the timer sequence is repeated in its entirety, and it does not complete the remainder of the interrupted sequence.

Figure 4:
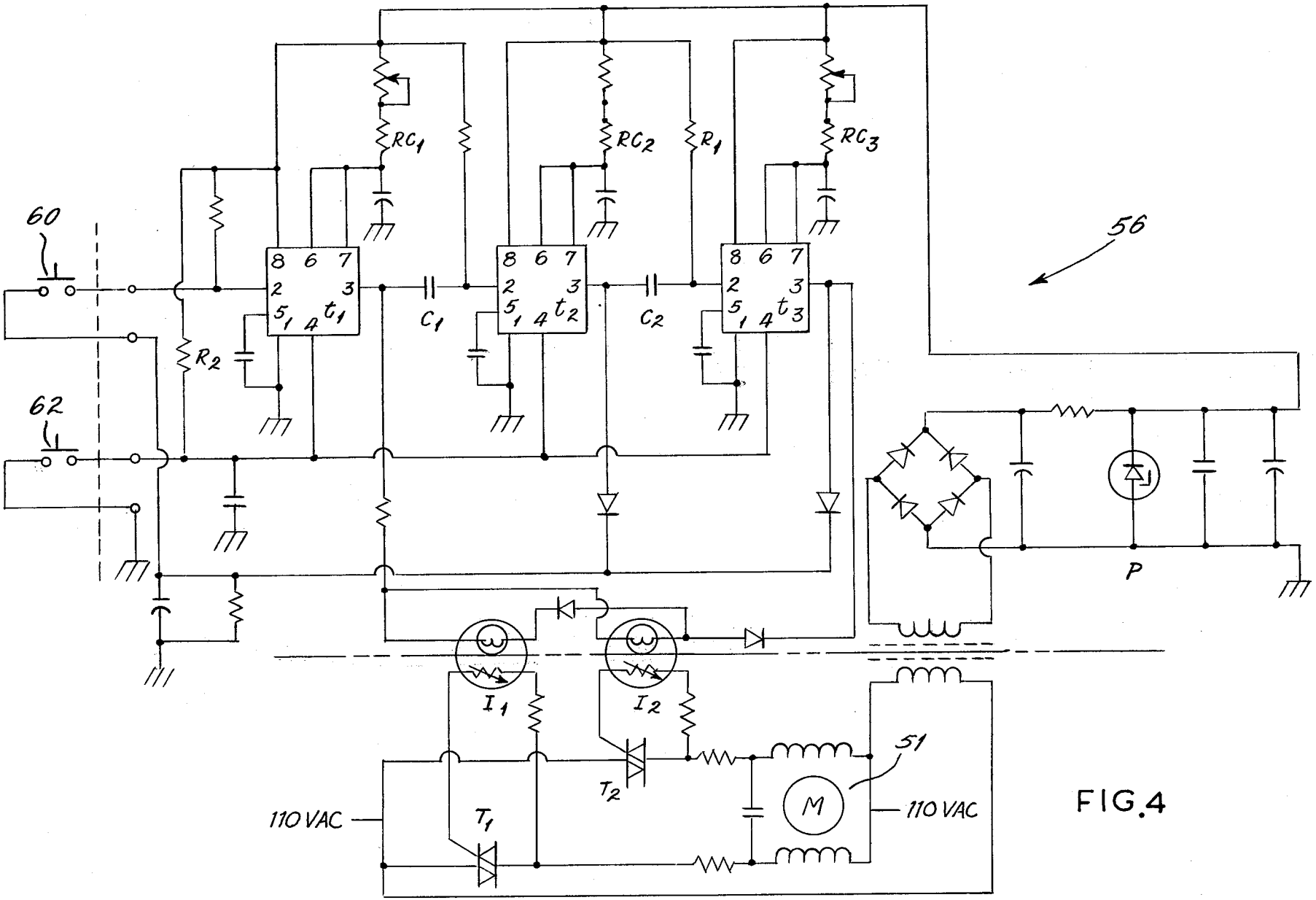
FIG. 4 is a schematic illustration of the electrical circuitry utilized in the present invention.

The timer unit 56 is actually a sequential timer circuit (FIG. 4) which utilizes three 555 times $t_1$, $t_2$ and $t_3$. The timer $t_1$ controls the time the motor 51 remains energized to drive the door D to its open position, while the timer $t_3$ controls the time the motor 51 remains energized to drive the door D to its closed position. The timer $t_2$, on the other hand, controls the time at which the motor 51 is de-energized between the operation of the timers $t_2$ and $t_3$, that is, while the door D is open. Thus, each timer $t_1$, $t_2$ and $t_3$ controls a different phase of the door-operating cycle. Each 555 timer is an integrated circuit having eight pins or terminals which are designated as follows.

1. ground
2. trigger
3. output
4. reset
5. control voltage
6. threshold
7. discharge
8. Vcc (voltage, collector current)

Basically, when the trigger pin 2 of each timer *t* is grounded or subjected to a low voltage pulse less than a prescribed value, the timer *t* will conduct current with the pin 3 going to a high voltage. The current is supplied to the timer *t* through the pin 8 which is always at the Vcc. The timer *t* conducts the current for a prescribed time and then the pin 3 goes low. The pins 6 and 7 are connected to an external RC network and the length of time the timer *t* conducts is dependent on values of the capacitance and the resistance in that network. This time may be varied by changing the resistance in the RC network such as by means of a potentiometer. The pin 4 resets the timer *t* when grounded, that is, it causes the timer *t* to go back to its initial or ready condition before completing its timing cycle. Pin 5 is used for filtering, should the timer *t* be employed in an environment which is noisy in an electrical sense. 555 timers are standard items of commerce which are available from several manufacturers of integrated circuits. One such manufacture is Signetics Corporation of Sunnyvale, Calif.

The circuit of the timer unit 56 includes (FIG. 4) a power supply P which furnishes direct regulated current at a voltage suitable for operating the timers $t_1$, $t_2$ and $t_3$. Basically, the power supply P includes a transformer for reducing 110 VAC to a lower voltage and a full wave rectifier for converting that reduced voltage to a direct current voltage such as 12 VDC which is suitable for the timers $t_1$, $t_2$ and $t_3$. One terminal of the rectifier is grounded, while the other or high voltage terminal is connected through the regulator of the power supply P to the pins 8 of the timers $t_1$, $t_2$ and $t_3$. The pins 2 are also connected to the high voltage terminal of the rectifier, but through resistors R so that the pins 2 are normally kept high. The start button 60 is connected between ground and the trigger pin 2 of the timer $t_1$. The trigger pin 2 of the timer $t_2$ is, on the other hand, connected to the output pin 3 of the timer $t_1$ through a capacitor $C_1$, whereas the trigger pin 2 of the timer $t_3$ is connected to the output pin 3 of the timer $t_2$ through another capacitor $C_2$. As previously mentioned, the pins 6 and 7 of all three timers $t_1$, $t_2$ and $t_3$ are connected with separate RC networks $RC_1$, $RC_2$ and $RC_3$, respectively. The resistance in the networks $RC_2$ and $RC_3$ include potentiometers and hence are variable. The hold button 62 is connected between ground and the pins 4 for the three timers $t_1$, $t_2$ and $t_3$. The pins 4 are normally maintained at high voltage inasmuch as they are connected to the high voltage terminal of the rectifier through a resistor $R_2$.

When the start button 60 is depressed, the trigger pin 2 of the tiner $t_1$ is grounded, that is, brought to low voltage. This triggers the timer $t_1$ in that its output pin 3 goes high, that is the voltage between it and ground is high in comparison to its previous condition. This charges the capacitor $C_1$. The output pin 3 remains high for the predetermined length of time, and then the timer $t_2$ times out, so to speak, sending the output pin 3 back close to ground potential. At the instant the pin 3 goes dead, the capacitor $C_1$ discharges and drives the trigger pin 2 of the timer $t_2$ low, thus setting that timer in operation. Thus, the output pin 3 of the timer $t_2$ goes high for a prescribed time and charges the capacitor $C_2$. At the end of that prescribed time, the output pin 3 for the timer $t_2$ goes dead and the capacitor $C_2$ discharges. The discharge of the capacitor $C_2$ drives the trigger pin 2 of the timer $t_3$ low, and as a result the pin 3 of that timer goes high for a predetermined time. The time intervals for which the timers $t_1$ and $t_3$ are energized, that is, the lengths of the time the output pins 3 are high, may be varied by adjusting the potentiometers in the RC networks $RC_1$ and $RC_3$, respectively.

The output pin 3 of the timer $t_1$ is connected to an opto-isolator $I_1$, which in effect is a light emitting diode and a light sensitive switch. When the output pin 3 goes to high voltage, the diode of the isolator $I_1$ is illuminated and this closes the light sensitive switch which is connected to the gate of a triac $T_1$, energizing that gate. This causes the triac $T_1$ to conduct and current flows through the field of the motor 51 and the drive shaft 52 rotates.

The output pin 3 of the third timer $t_3$ is connected to the light emitting diode of another opto-isolator $I_2$ such that when the pin 3 of that timer $t_3$ goes high, the light emitting diode of the isolator $I_2$ is energized and causes the light sensitive switch thereof to close. That light sensitive switch is connected to the gate of another triac $T_2$ and when the gate is energized the triac $T_2$ conducts current, with the current flowing through the field of the motor 51. However, the polarity is reversed so that the main shaft 52 operates in the opposite direction.

OPERATION

Normally, the door D is closed in which case it blocks the opening O through the wall W. One desiring to pass through the opening O presses the most convenient start button 60 which energizes the timer unit 56. The timer unit 56 in turn energizes the motor 51 causing it to rotate the drive shaft 52 the direction which opens the door D. In other words, the drive pulley 54 rotates and drives the cable 40 in the direction which opens the door D. The timer unit 56 keeps the motor 51 energized long enough to move the door D to its fully open position, in which case it is housed completely within the pocket 28. When the door D reaches its fully open position its back edge strikes the bumper 29 on double studs 6*a*. The motor 51 may continue to operate for a short time after the door D strikes the bumper 29, but in that case the pulley 54 merely slips within the loop of the cable 40. In this regard, the spring 42 while maintaining the cable 40 taut, does not exert so much tension as to prevent all slippage between the cable 40 and the drive pulley 54. The length of time the motor 51 operates is controlled by adjusting the potentiometer of the RC network $RC_1$.

Once the door D reaches its open position, the timer unit 56 de-energizes the motor 51 long enough for one to pass through the opening O. Then the timer unit 56 energizes the motor 51 in the opposite direction, in which case the drive pulley 54 rotates in the direction which causes the cable 40 to close the door D. In particular, the closure force on the door D is transmitted from the drive pulley 54 to the idler pulley 20 through the cable 40 and thence in the opposite direction to the door D through the cable 40 and spring 42. Again, the timer unit 56 keeps the motor 51 energized long enough to completely close the door D. This time may be varied by adjusting the potentiometer of the RC network $RC_2$. A typical sequence for the motor 51 when used with a 36 inch door is 3 seconds run to open, 3 seconds hold in the open position, and 3 seconds run to close.

Should the door D encounter an obstruction upon closing, the motor 51 will continue to run for the full sequence, that is until it times out, notwithstanding the fact that the door D cannot move any further. However, the force applied to the cable 40 will merely stretch the spring 42 slightly, and inrease the slack in the cable 40 so as to speak. This in turn, loosens the cable 40 at the drive pulley 54 so that the pulley 54 slips easily within the loop of the cable 40. In such an instance, the force exerted on the door D is enough to close the door D when the obstruction is removed, but is not enough to injure someone. Thus, if an individual's leg or arm becomes caught in the door D no injury will occur.

When the motor 51 times out, the door D will remain in its partially closed position. Once the obstruction is removed, the door D may be moved to its fully closed position by hand, in which case the cable 40 merely slips around the drive pulley 54. It may also be moved to its fully closed position by depressing the start button 60. Once the button 60 is depressed, the timer unit 56 repeates its entire sequence, and the motor 51 does so likewise. Thus, the door D will move from the partially closed position to the fully open position, but since this requires less time than the opening sequence set into the timer unit 56, the pulley 54 will merely slip within the loop of the cable 40 for a short interval after it reaches its fully open position. Then the timer unit 56 completes its sequence, holding for the prescribed interval and then energizing the motor 51 to close the door D.

If it is desired to retain the door D in its open position, the start button 60 is depressed, causing the timer unit 56 to energize the motor 51. When the door D reaches its fully open position and the timer unit 56 enters its hold phase, the hold button 62 is depressed. This de-energizes the timer unit 56 and causes it to revert to its initial condition. The door D, however, remains open since the motor 51 does not operate until the timer unit 56 is again energized.

To bring the door D back to its closed position, the start button 60 is depressed and this causes the timer unit 56 to go through its full sequence. Hence, the motor 51 will rotate in the direction which opens the door D, but since the door D is already open, the drive pulley 54 will merely slip in the loop of the cable 40. Thereafter, the timer unit 56 enters its hold phase and then its close phase, and during the close phase the motor 51 moves the door D to its closed position.

Should a power failure occur, in which case neither the timer unit 56 nor motor 51 will operate, the door D can be opened or closed by hand. In that case, the cable 40 merely slips over the drive pulley 54.

This invention is intended to cover all changes and modifications of the example of the invention herein chosen for purposes of the disclosure which do not constitute departures from the spirit and scope of the invention.

What is claimed is:

1. For use with a door mounted on a track and movable parallel to the track between open and closed positions relative to an opening in a wall, an improved apparatus for moving the door between its open and closed positions, said apparatus comprising: an electric motor mounted in a fixed position relative to the door opening and being connected with a drive pulley which the motor is capable of turning in either direction of rotation; an idler pulley spaced from the drive pulley; a cable looped around the drive and idler pulleys and attached to the door such that when the drive pulley is rotated in one direction, the door is urged to its open position, and when the drive pulley is rotated in the opposite direction, the door is urged to its closed position, the drive pulley being capable of slipping relative to the cable; and timing means which when actuated causes the motor to undergo a single door operating cycle wherein the motor first rotates the drive pulley for a predetermined span of time in the direction which urges the door to its open position and thereafter rotates the drive pulley for a predetermined span of time in the opposite direction which urges the door to its closed position, said predetermined spans of time being sufficient in duration to under normal circumstances completely move the door from one position to the other, said predetermined times being constant and completely independent of the door position, whereby the time the motor rotates the drive pulley in one direction and then in the other will be the same irrespective of the position of the door.

2. An apparatus according to claim 1 wherein the operating cycle controlled by the timing means further includes a hold condition of predetermined time between completion of drive pulley rotation in the direction which opens the door and the commencement of drive pulley rotation in the direction which closes the door, the drive pulley being idle during the hold condition so as not to urge the door in either direction.

3. An apparatus according to claim 1 wherein the timing means includes means for adjusting the predetermined spans of time for the operating cycle.

4. An apparatus according to claim 1 and further comprising a spring connected with the cable for maintaining the cable taut about the drive and idler pulleys.

5. An apparatus according to claim 1 and further comprising means for terminating the operating cycle at any time before its normal completion.

6. An apparatus according to claim 1 and further comprising first manually operated means for actuating the timing means so as to initiate the operating cycle and second manually operated means for terminating the operating cycle at any time before its normal completion.

7. An apparatus according to claim 1 wherein the wall has a pair of upright supporting members between which the track extends; wherein the electric motor and timing means form part of a drive unit having a supporting bracket which attaches to one of the upright supporting members on the side of that member facing away from the end of the track so that said one member is between the track and the drive unit; and wherein the cable extends through holes of the upright member.

8. The structure according to claim 7 wherein the cable has two reaches, both of which extend through holes in the bracket which holes align with the holes in said one upright member, and the drive unit does not project laterally beyond the upright members irrespective of the manner in which the holes in the bracket are aligned with the holes in the upright member so that the drive unit may be mounted on said one upright member with the drive pulley presented upwardly or downwardly.

9. An apparatus for automatically operating a pocket door which is mounted on a track in a wall having a pocket therein and an opening adjacent to the pocket, the door being movable on the track between an open position wherein it blocks the opening and a closed position wherein it is within the pocket and does not obstruct the opening, said apparatus comprising: drive means mounted on the wall beyond the opening therein for rotating a drive pulley in both directions about the axis of the pulley; an idler pulley spaced from the drive pulley; a cable looped around the drive and idler pulleys and attached to the door such that when the drive pulley rotates in one direction the door is urged to its open position and when the drive pulley rotates in the opposite direction the door is urged to its closed position; means for maintaining the cable taut and for further permitting a slight amount of slack to develop in the cable so that if the door encounters an obstruction during movement, the drive pulley will slip relative to the cable; and timing means for controlling the drive means, the timing means upon being actuated first causing the drive means to rotate the pulley for a first predetermined time in the direction which causes the door to open and then for a second predetermined time in the direction which causes the door to close, said first predetermined time being long enough to normally let the door move from its closed to its open position and said second predetermined time being long enough to normally let the door move from its open to its closed position, said first and second predetermined times being constant, the timing means being independent of the door so that once actuated the timing means will energize the drive means for said first and second predetermined times irrespective of the position of the door.

10. An apparatus according to claim 9 wherein the means for maintaining the cable taut is a spring.

11. An apparatus according to claim 9 wherein the timing means further de-energizes the motor for an intermediate predetermined time after the first predetermined time and before the second predetermined time.

12. An apparatus according to claim 11 and further comprising a manually operated switching means connected to the timing means such that the timing means is actuated when the switching means is operated and causes the drive means to rotate the pulley in the direction which opens the door; and wherein the timing means comprises a first, second, and third timers, the first timer being activated by the manually operated switching means and determining the first predetermined time, the second timer being activated by the first timer and determining the intermediate predetermined time, and the third timer being activated by the second timer and determining the second predetermined time.

13. An apparatus according to claim 2 and further comprising manually operated means for actuating the timing means so as to initiate the operating cycle; and wherein the timing means includes a sequential timer circuit having three phases corresponding in duration to and controlling the three phases corresponding in duration to and controlling the three predetermined times of door operating cycle, the first phase being initiated by the manually operated means and controlling the time for operating the motor in the door-operating direction, the second phase being initiated by the first phase and controlling the time of the hold condition, and the third phase being initiated by the second phase and controlling the time for operating the motor in the door-closing direction.

14. For use with a door mounted on a track and movable parallel to the track between open and closed positions relative to an opening in a wall, an improved apparatus for moving the door between its open and closed positions, said apparatus comprising: a drive pulley; an electric motor mounted in a fixed position relative to the door opening and connected to the drive pulley, the motor being capable of turning the drive pulley in either direction of rotation; an idler pulley spaced from the drive pulley; a cable looped around the drive and idler pulleys and attached to the door such that when the drive pulley is rotated in one direction, the door is urged to its open position, and when the drive pulley is rotated in the opposite direction, the door is urged to its closed position, the drive pulley being capable of slipping relative to the cable; and timing means which when actuated causes the motor to undergo a single door operating cycle wherein the motor rotates the drive pulley for at least one uninterrupted span of time in one direction so as to urge the door from one position to the other position, said span of time being constant and of sufficient duration to enable the door under normal circumstances to completely move from the one position to the other position, the timing means further being completely independent of the door position so that the time the motor rotates the drive pulley will be the same irrespective of the position of the door.

* * * * *